United States Patent [19]

Spence

[11] Patent Number: 4,552,106

[45] Date of Patent: Nov. 12, 1985

[54] INTERNAL COMBUSTION ENGINE

[75] Inventor: Lewis C. Spence, Jupiter, Fla.

[73] Assignee: John P. Ohl, Palm Beach, Fla.

[21] Appl. No.: 446,502

[22] Filed: Dec. 3, 1982

[51] Int. Cl.[4] ..... F02B 3/00

[52] U.S. Cl. ..... 123/198 A; 123/25 P; 123/25 D

[58] Field of Search ..... 123/25 R, 25 C, 198 A, 123/1 A, 1 R, 25 P; 60/712

[56] References Cited

U.S. PATENT DOCUMENTS

| | | | |
|---|---|---|---|
| 864,877 | 9/1907 | Woolf | 123/25 C |
| 885,820 | 4/1908 | Winand | 123/25 C |
| 1,068,414 | 7/1913 | Courtenay | 123/25 P |
| 1,791,523 | 2/1931 | Chaudet | 123/25 D |
| 1,848,380 | 3/1932 | Parks | 123/25 C |
| 2,101,554 | 12/1937 | Meyer | 123/25 C |
| 2,671,311 | 3/1954 | Rohrbach | 123/25 C |
| 2,862,481 | 12/1958 | Rounds | 123/1 A |
| 3,842,808 | 10/1974 | Cataldo | 123/25 P |
| 3,844,262 | 10/1974 | Dieges | 123/1 A |
| 3,896,775 | 7/1975 | Melby | 123/64 |
| 3,964,263 | 6/1976 | Tibbs | 60/618 |
| 4,143,518 | 3/1979 | Kellogg-Smith | 60/712 |
| 4,279,223 | 7/1981 | Csonka | 123/25 C |
| 4,402,182 | 9/1983 | Miller | 123/25 P |

*Primary Examiner*—Ronald H. Lazarus

*Attorney, Agent, or Firm*—Saidman, Sterne, Kessler & Goldstein

[57] ABSTRACT

A modified two-stroke or four-stroke internal combustion engine comprises means and a method for increasing the power output of an internal combustion engine by providing a non-combustible fluid to the engine. The engine transfers thermal energy of combustion to the non-combustible fluid, thereby causing expansion of the fluid, and includes means for converting expansion of the fluid to mechanical power.

1 Claim, 5 Drawing Figures

INTERNAL COMBUSTION ENGINE

BACKGROUND OF THE INVENTION

1. Field of the Invention

The present invention relates to internal combustion engines. Particularly, the present invention pertains to means and a method for increasing both the power and efficiency of conventional internal combustion engines.

2. Description of the Related Art

Internal combustion engines running on hydrocarbon fuel have long been used as a source of power. In recent years, however, the fuel inefficiency, noise, pollution, and high cost of operation have become increasingly severe problems.

Conventional internal combustion engines generally operate on either a two-stroke or four-stroke cycle. A complete cycle in a four-cycle engine produces two complete revolutions of the crank shaft. Starting with the piston at top dead center (TDC), as the piston moves down, the intake valve opens, allowing the piston displacement to create a vacuum, drawing a fuel-air mixture into the cylinder. The intake valve closes, and the piston moves upwardly toward the cylinder head, compressing the fuel-air mixture in the cylinder. When the piston reaches TDC (+/− a few degrees), an electrical spark ignites the compressed fuel-air mixture; the explosive expansion of the mixture drives the piston downwardly in the power stroke. The exhaust valve then opens, and an upward movement of the piston expels the residual gases from the cylinder.

A two-stroke engine operates in much the same manner, combining the power, exhaust, intake and compression strokes into a single revolution.

The internal combustion process produces considerable heat which is stored in the cylinder head, walls and piston of the engine. This latent heat must be disposed of before temperature levels become sufficiently high to destroy the engine. In many conventional engines, the preferred method for disposing of the heat is with a forced fan radiator and liquid coolant.

Vast amounts of energy are wasted during operation of a conventional internal combustion engine. Thermal energy is wasted in the form of extremely hot gases being exhausted to the atmosphere. Heat removed from the engine parts by the coolant is also simply blown off into the atmosphere. Additionally, much of the energy generated by the engine is consumed in driving the pumps and fans of the cooling system. In short, only a small portion of the energy generated by the engine is used to produce useful work.

Many devices and techniques have been developed in recent years for the purpose of increasing the power output and fuel efficiency of internal combustion engines. Most such devices have met with limited success; the nature of internal combustion engines, and the manner in which they produce power, has changed little.

Other techniques have been developed to provide increased power output. One such technique includes injecting a second combustible fluid into the engine cylinder, usually after primary ignition and combustion have occurred. Another technique is described, for example, in U.S. Pat. No. 4,143,518 to Kellogg-Smith, which discloses a six-stroke internal combustion engine. Water is injected into the cylinders and is converted to steam by the residual heat from the hydrocarbon ignition of the first power stroke, providing the motive force for a second power stroke. The apparatus disclosed in this patent differs substantially from conventional internal combustion engines, functioning on a six-stroke cycle and having additional exhaust valves and exhaust gas chambers associated with each cylinder. U.S. Pat. No. 3,964,263 to Tibbs also discloses a six-stroke internal combustion engine wherein water is injected into the heated cylinder following the exhaust stroke. While the arrangement of Tibbs requires only a single exhaust valve, it is still necessary that the timing and operational sequence of a conventional engine be altered so that it may function on a six-stroke cycle. U.S. Pat. No. 3,896,775 to Melby discloses a six-stroke supercharged internal combustion engine wherein the exhaust from a first power stroke is returned to a cylinder, along with new air, for a second power stroke. This apparatus also requires substantial modification to known engine designs so that it may operate on a six stroke cycle. The techniques employed to date exhaust all residual gases to the atmosphere.

It is an object of the present invention to overcome the problems associated with conventional internal combustion engines, and to provide an engine having greater power output and increased fuel efficiency.

It is an object of the present invention to reduce the volume of exhaust emission from an internal combustion engine at any given power output.

It is a further object of the invention to provide an internal combustion engine having cooler exhaust emissions, reduced emission noise, and emitting a lower level of contaminants to the atmosphere as compared to prior art engines.

It is a further object of the present invention to provide both means and a method for converting waste heat produced by conventional engines into usable energy.

It is a further object of this invention to provide both means and a method for adapting presently available two-stroke and four-stroke engine designs to operate at substantially greater efficiency, thereby facilitating manufacture of more highly efficient engines without extensive re-tooling costs.

It is a further object of this invention to extend useful engine life by reducing engine operating temperature, thereby placing less strain on the lubricants.

SUMMARY OF THE INVENTION

The present invention is directed to a two- or four-stroke internal combustion engine and to a related method of operation thereof. During engine operation, a non-combustible fluid is provided to the engine. Thermal energy is transferred from the residual gases of combustion to the non-combustible fluid, causing the fluid to expand as a gas. The energy of the expanding gas is converted to mechanical power. The non-combustible fluid may be provided to the cylinder(s) during the power stroke following ignition of the fuel, so that the non-combustible fluid absorbs heat from the burning/burned fuel in the cylinder(s). The non-combustible fluid comprises an element or compound exhibiting high thermal expansion characteristics with noble character over an extended temperature range.

Provision is made for recovering the non-combustible fluid, and for recycling it. The fluid may be recovered after it is exhausted from the cylinder. This includes means for separating the non-combustible gases from exhaust gases, for recondensing the non-combustible gas to a fluid and for recycling the condensed fluid to be reinjected into the cylinder(s).

In a preferred embodiment, the non-combustible fluid is provided to the cylinder(s) in liquid form. The liquid vaporizes and expands upon contacting the gases produced by the burning of the ignited combustible fuel. Following the power stroke, the contents of the cylinder(s) are exhausted and cooled. The vaporized non-combustible fluid cools and condenses more rapidly than the gaseous products of combustion, thereby permitting recovery of the non-combustible fluid. The recovered fluid is returned to the cylinder(s) during a subsequent power stroke.

The non-combustible fluid is provided to the cylinder(s) in a quantity sufficient to absorb a maximum amount of heat in the ignited combustible fuel. The ignited fuel in the cylinder(s) is cooled by contact with the non-combustible fluid, which absorbs heat therefrom. This inhibits heat buildup in the cylinder and permits the engine to run cooler.

DETAILED DESCRIPTION OF THE INVENTION

A conventional internal combustion engine generates mechanical power by igniting and expanding combustible fuel within a cylinder. The fuel is ignited when the piston within the cylinder is at approximately TDC (+/− a few degrees). The expanding gases force the piston downward, turning a crank shaft. However, once the ignited fuel has expanded fully, continued downward movement of the piston produces a vacuum within the cylinder. This must be overcome with inertia to make the engine continue to turn. A flywheel (not shown) coupled with the crank shaft in a known manner, carries the piston through the remainder of the power stroke and through the exhaust stroke. The inertia must be sufficient to continue to turn the engine through the intake and compression strokes as well.

The vacuum created during the latter portion of the power stroke impedes motion of the engine and seriously reduces its power output. Evidence suggests that the conventional engine runs in a vacuum during a portion of rotation of the crank shaft during the power stroke (e.g., from approximately 45 degrees of rotation to about 180 degrees of rotation). The duration of the vacuum portion of the power stroke could be reduced by providing additional combustible fuel to the cylinder. This is the means used by conventional engines to increase power.

The present invention overcomes this shortcoming of the internal combustion engine by providing a non-combustible fluid to the cylinder during the power stroke. The non-combustible fluid, generally provided in liquid form, vaporizes and expands within the cylinder, increasing pressure during the power stroke and boosting power output. The present invention operates on a closed loop principle as will be discussed with reference to the drawings. The present invention includes means for recovering the non-combustible fluid from the cylinder, and returning the fluid to the cylinder for repeated use.

Figure 1:
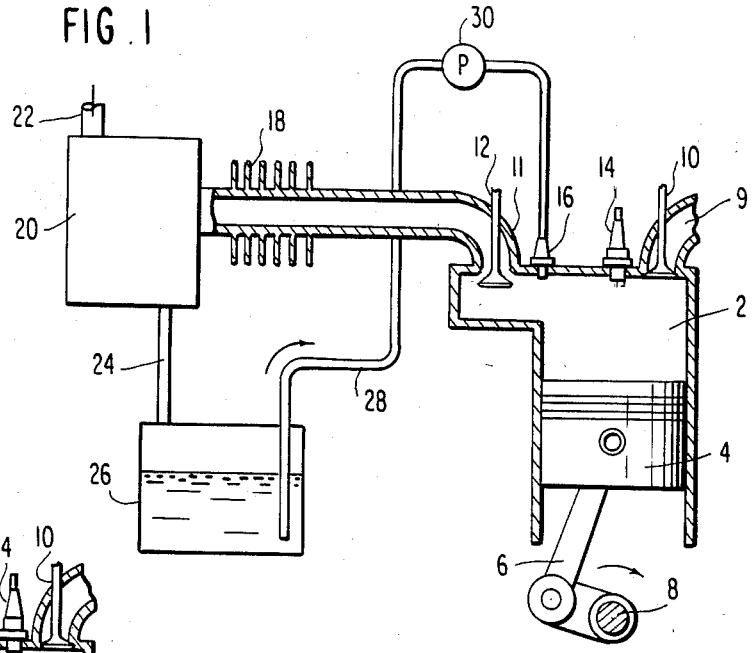
FIG. 1 schematically illustrates the essential components of an internal combustion engine in accordance with the present invention.

FIG. 1 illustrates the essential components of an engine in accordance with a preferred embodiment of the present invention. The engine comprises at least one conventional cylinder 2 having a piston 4 reciprocable therein. The piston is connected to an arm 6 and a crank shaft 8 in the usual manner. An intake port 9 and a valve 10 provides a mixture of combustible fuel and air to the cylinder, while an exhaust port 11 and a valve 12 permits removal of spent fuel from the cylinder. An ignition means, such as a conventional spark plug 14, is provided for igniting the fuel.

An injector 16, which may be of conventional configuration, provides a non-combustible fluid to the cylinder. In a preferred embodiment, the fluid is provided to the cylinder in the form of a liquid.

Exhaust from the cylinder, which will include spent combustible fuels as well as the non-combustible gases, passes through exhaust port 11 to a cooling means 18 and a separator 20. The cooled non-combustible gas in the exhaust is separated from the spent combustible fuel. A characteristic of the non-combustible fluid is that it will condense much more quickly than the rest of the exhaust gases. Thus, the latter will exit through an exhaust 22, while the condensed fluid will pass through conduit means 24 to a sump 26. A pump 30 draws the non-combustible fluid from the sump 26 through conduit means 28, and provides it again to injector 16. The mode of operation of the apparatus of FIG. 1 will be discussed with respect to FIGS. 2–5.

Figure 2:
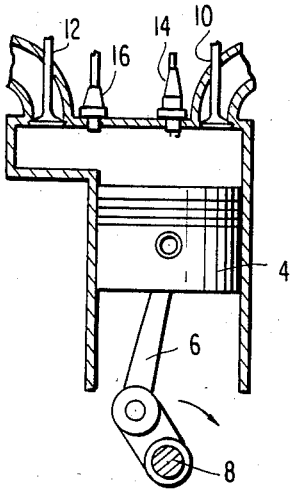
FIG. 2 illustrates the apparatus of FIG. 1 in operation as it completes the compression stroke, with the piston approaching TDC.
Figure 3:
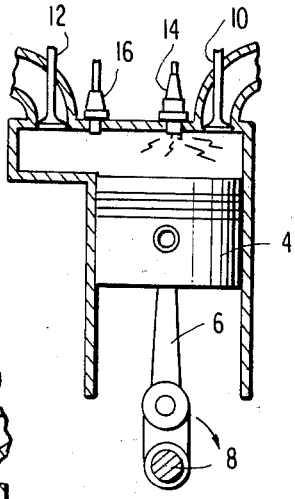
FIG. 3 illustrates the apparatus of FIG. 1 upon ignition of combustible fuel therein, with the piston being just past TDC.
Figure 4:
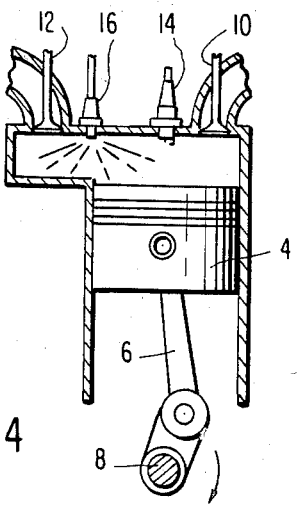
FIG. 4 illustrates the same apparatus in operation upon injection of the non-combustible fluid during the power stroke.

FIG. 2 illustrates the position of piston 4 as it is completing the compression stroke, approaching TDC. Both ports 9 and 11 are closed at this point. As piston 4 reaches TDC (+/− a few degrees), spark plug 14 ignites the combustible fuel in the cylinder. The ignited fuel expands, forcing piston 4 downward and turning crank shaft 8.

During the power stroke, a non-combustible fluid is injected into cylinder 2 by injector 16. This fluid contacts the heated fuel in the cylinder, absorbs heat therefrom and becomes vaporized. The fluid expands rapidly upon vaporization, increasing the pressure within the cylinder, preventing a vacuum from developing, and substantially increasing the power output of the engine. Heat absorbed by the fluid reduces the temperature of gases within the cylinder, and reduces the heating effect on engine parts.

The non-combustible fluid is preferably injected into cylinder 2 in sufficient quantity to balance the heat produced by the burning fuel. The non-combustible fluid thus absorbs heat from the combustion gases before latent heat can penetrate the cylinder parts and converts it to useful energy. The operating temperature of the engine can be controlled in this manner.

Figure 5:
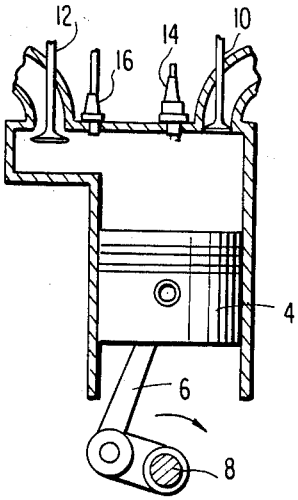
FIG. 5 illustrates the apparatus as it completes the exhaust stroke.

Following completion of the power stroke, exhaust port 11 is opened, as illustrated in FIG. 5, and the combined spent fuel and non-combustible fluid is exhausted from cylinder 2.

A great portion of the energy derived from the air-fuel mixture in internal combustion engines is wasted in the form of heat. The present invention converts a large portion of that heat, which is normally wasted, into usable mechanical power.

After being exhausted from cylinder 2 through exhaust port 11, the residual mixture of vaporized non-combustible fluid and gases of combustion enters cooling means 18. In cooling means 18, the exhaust mixture, which is already at a relatively low temperature following absorption of heat by the gas, is further cooled, facilitating condensation of the non-combustible fluid. The fluid will liquify when the temperature is reduced, and will separate in separating means 20 from the combustion gases generated by the burned fuel. The remaining gases are exhausted through exhaust means 22 in a conventional manner.

The condensed fluid passes through conduit means 24 to sump 26, constituting a reservoir for the fluid. Pump 30, or other suitable means, draws the fluid through conduit means 28 and returns it to injector 16 to be used in a subsequent power stroke.

Fluids suitable for use in the present invention are non-combustible chemical elements or compounds having certain properties. They must be non-combustible, of noble character, and exhibit good temperature expansion characteristics. Examples of such fluids are the halogens. The selection of a particular non-combustible fluid to be used may be made dependent on the environment in which the engine will function.

Compared with a conventional engine, the present invention is thus capable of producing substantially increased power without substantially increasing fuel consumption.

In the case where the non-combustible fluid is injected at or about the point of flame-out, after the burning fuels have reached their maximum temperature, the residual heat in the gases has not penetrated the cylinder walls, head, piston, etc., as time is required for latent heat to penetrate and build up on these parts. The non-combustible fluid, injected as a liquid, will vaporize and geometrically reduce the temperature of the burning or burned gases of combustion while expanding to accommodate this heat. The expanding non-combustible fluid (now in a gaseous state) will drive the piston down, producing power to the bottom of the power stroke. The non-combustible fluid, being of noble character, will readily liquify when the temperature is reduced, allowing recovery. This results in a closed system operating in conjunction with an open system (comprising the exhaust gas from combustion). The residue from the burned air/fuel mixture remains a gas and can be exhausted to the atmosphere. The temperature and volume of the exhaust gas (from the burned air/fuel mixture) is reduced to approach ambient before being exhausted. This reduces the volume of exhaust as well as heat contamination of the environment.

Since the conventional combustion engine is thought to run in a vacuum for up to 50% of the power stroke, this must be overcome with inertia to make the engine continue to turn. The flywheel carries the piston through the exhaust stroke as well as through a partial vacuum on the intake stroke. This inertia must continue to turn the engine and be of sufficient magnitude to complete the compression stroke.

With the approach taken by the present invention, the air/fuel mixture ignites at about TDC (+/− a few degrees), as is done in a conventional engine. In one embodiment, ignition occurs about 2 degrees past TDC. Maximum pressure is experienced in the next few degrees of the turn of the crank shaft. If this maximum pressure could be realized at approximately 90 degrees, the maximum transfer of energy would occur to the crank shaft.

Present thinking with considerable evidence suggests that the conventional engine runs in a vacuum from somewhere around the 45 degree point to about 180 degrees on the power stroke. This situation changes and the vacuum portion of the power stroke becomes less as additional fuel/air mixture is added. As the vacuum portion of the stroke is reduced, engine energy production increases.

A primary feature of this invention is that an increase in power can be derived from a non-combustible heavy gas injected after flame-out, when the burning fuel has reached its highest temperature. This corresponds with about 20 degrees past TDC. At that point, the crank shaft angle is in a more satisfactory position to convert expansion pressure of the non-combustible gas to mechanical energy. The quantity of non-combustible fluid injected can drive the piston to the 180 degree position, thereby substantially eliminating the partial vacuum that may exist in a conventional mode.

The present invention provides means and a method for increasing the power output of internal combustion engines without increasing fuel consumption. Thus, at any given power level, fuel consumption can be greatly reduced as compared to conventional engines now in use. The volume of emissions from the engine is also reduced due to the reduced fuel consumption. Additionally, since much of the thermal energy formerly expelled into the atmosphere is converted into useful power exhaust from the engine of the present invention is substantially cooler than that from conventional engines, thus reducing thermal pollution.

The closed loop system of the present invention, utilizing a non-combustible fluid and operating in conjunction with conventional fuel, effectively converts waste heat into useful energy without requiring additional consumption of any fuel whatsoever. This effectively reduces operating costs of the engine, and conserves hydrocarbon fuels which are becoming increasingly scarce and expensive. An engine in accordance with the present invention will run more efficiently and more quietly than conventional engines, emitting substantially reduced pollutants into the atmosphere. As a further advantage, engine life will be extended.

The invention is described here with respect to a single cylinder of an engine operating on a four-stroke cycle. It is to be understood that the present invention is also applicable to engines having multiple cylinders as well as to engines operating on a two-stroke cycle.

The invention may be embodied in other specific forms without departing from the spirit or essential characteristics thereof. The present embodiments, therefore, are to be considered in all respects as illustrative and not restrictive, of the scope of the invention being indicated by the appended claims rather than by the foregoing description, and all changes which come within the meaning and range of equivalency of the claims are therefore intended to be embraced therein.

I claim as my invention:

1. An internal combustion engine operating on a two-stroke cycle or a four-stroke cycly having a power stroke, comprising:

means for providing a combustible fuel to said engine at the start of the power stroke;

first means for igniting said fuel during the power stroke to produce mechanical power;

means for providing a non-combustible fluid to said engine during the power stroke after said first means has ignited said fuel and after said ignited fuel has substantially reached the point of flame-out in order to transfer thermal energy from said ignited fuel to said non-combustible fluid, thereby causing expansion of said fluid during the power stroke; and means for converting expansion of said fluid to mechanical power during the power stroke, wherein said non-combustible fluid comprises a fluid having good temperature expansion characteristics and which condenses at a substantially faster rate than burned combustible fuel exhausted from the engine, and wherein said non-combustible liquid comprises a halogen.

* * * * *